US007930977B2

(12) United States Patent
Klein

(10) Patent No.: US 7,930,977 B2
(45) Date of Patent: Apr. 26, 2011

(54) NON-LETHAL PROJECTILE AMMUNITION

(76) Inventor: John M. Klein, Harrisville, MI (US)

( * ) Notice: Subject to any disclaimer, the term of this patent is extended or adjusted under 35 U.S.C. 154(b) by 409 days.

(21) Appl. No.: 12/072,350

(22) Filed: Feb. 26, 2008

(65) Prior Publication Data

US 2011/0067593 A1 Mar. 24, 2011

Related U.S. Application Data

(60) Provisional application No. 60/903,436, filed on Feb. 26, 2007.

(51) Int. Cl.
*F42B 8/02* (2006.01)
*F42B 8/12* (2006.01)

(52) U.S. Cl. ..... 102/447; 102/444; 102/502

(58) Field of Classification Search ..... 102/444, 102/447, 498, 502, 529
See application file for complete search history.

(56) References Cited

U.S. PATENT DOCUMENTS

| | | | | |
|---|---|---|---|---|
| H000114 | H * | 8/1986 | Quintavalle | 102/513 |
| 5,402,729 | A * | 4/1995 | Richert | 102/439 |
| 6,041,712 | A * | 3/2000 | Lyon | 102/439 |
| 6,302,028 | B1 * | 10/2001 | Guillot-Ulmann et al. | 102/502 |
| 6,832,557 | B2 * | 12/2004 | Torsten | 102/439 |
| 7,287,475 | B2 * | 10/2007 | Brunn | 102/444 |

FOREIGN PATENT DOCUMENTS

GB 2220467 A * 1/1990

* cited by examiner

*Primary Examiner* — Bret Hayes
(74) *Attorney, Agent, or Firm* — The Weintraub Group, P.L.C.

(57) ABSTRACT

Non-lethal ammunition for a riot gun assembles a bi-chambered projectile body and an impact nose, the assembly being spin-stabilized and nose-heavy such that the nose will impact first at the target. The rearward end of the assembly is mounted into the forward end of a shell casing having a high-energy gas expansion chamber, the mounting forming a low-pressure chamber at the rearward end of the projectile. A cup-shaped multi-port gas diffuser plug, spaced from the projectile body, directs burnt propellant gases from the expansion chamber into the low-pressure chamber to expel the projectile at a relatively low velocity. A sleeve interiorly of the gas diffuser plug closes the ports and is degraded by the burnt gases to provide a complete burning of the propellant.

17 Claims, 3 Drawing Sheets

NON-LETHAL PROJECTILE AMMUNITION

CROSS-REFERENCE TO RELATED APPLICATION

This application is a completion application of and claims the benefit of U.S. Provisional Application No. 60/903,436, filed Feb. 26, 2007, the entire disclosure of which is incorporated herein in its entirety.

BACKGROUND OF THE INVENTION

1. Field of the Invention

This invention relates to the field of non-lethal/less lethal ammunition wherein a projectile, such as used in riot control, is fired from the barrel of a held grenade launcher and, respectively, shatters to release a dye or gas and/or remains intact upon impact, respectively, to produce trauma. More specifically, the invention relates to such ammunition having a high/low gas propulsion system wherein high-energy propellant gases are created in a small high pressure chamber, efficiently burned, and the high pressure instantaneously released into a larger volume to expel the projectile from a cartridge and the barrel of a gun at a controlled relatively low exit velocity, and a projectile having a configuration such that the nose thereof will hit a specifically identified target upon impact.

2. Description of the Prior Art

Non-lethal or less lethal ammunition provides friendly forces with the capability to stop, confuse, disorient, or momentarily deter a potential threat without using deadly force. Military forces and local police units use non-lethal ammunition to apply the minimum force necessary while performing functions of crowd control and site area security. In particular, the non-lethal/less lethal ammunition is intended to be a direct fire, low hazard, non-shrapnel producing device that statistically will produce less lethal trauma upon impact and a low probability of death upon impact.

Typically, the less-lethal ammunition includes a large caliber metallic cartridge case that fits into the chamber of the launcher, a smooth or rifled barrel, a projectile, a smaller caliber propelling charge, such as a .38 or .44 that houses a percussion cap, and a propellant to expel the projectile. The large caliber cartridge case is in the form of a cylindrical shell casing with the forward end portion receiving the projectile and the rearward end portion receiving the smaller caliber cartridge propelling charge case inclusive of propellant and percussion cap. In use, the cap is struck by a firing pin, the propellant ignited, and the efficient burning of the propellant in a confined area generates a pressurized gas that instantaneously releases its pressure into the larger cartridge case and forces the projectile out of the forward end portion of the large caliber cartridge casing and then, typically, through the bore of a smooth or rifled barrel.

The propellant is oftentimes in the form of gunpowder that fills the small caliber shell casing of a conventional pistol cartridge, such as a commercially available .38 or .44 caliber cartridge. The powder in the shell when ignited provides a high energy burst of gas that expels the projectile from the large caliber cartridge and at a high velocity. The hi-lo system, as described in the previous paragraph differs in operational concept to the system described herein. Riot control ammunition and less lethal ammunition is considered to be non-lethal or less lethal if the projectile velocity is low and usually lethal if the projectile velocity is high.

U.S. Pat. No. 5,086,703 (issued Feb. 11, 1992) to Klein discloses a non-lethal riot control cartridge wherein the intention is to accelerate a relatively large mass (relative to the amount of propellant involved) to a relatively low velocity, which Patent is specifically incorporated herein by reference.

In Klein, a large caliber such as a 37 mm or 40 mm metal cartridge contains and seats a small propelling charge such as a .38 or .44 caliber inside a chamber formed at the rearward end of a bi-chambered projectile. When the percussion cap in the cartridge is fired, high-pressure propellant gases fill the projectile chamber and force the projectile forwardly with respect to the cartridge. Upon reaching and moving forward of the propelling charge, the high pressure gas is released into the larger volume of the 37 mm or 40 mm cartridge case, forcing the projectile through the barrel of a grenade-launching weapon. The result is the creation of a high-pressure chamber within the metallic cartridge and the base of the projectile and a low-pressure chamber within the larger 37 mm or 40 mm cartridge case located in the space behind the projectile as the projectile moves forward, clearing the expulsion end of the .38 or .44 cartridge case to exit the weapon. Such a system is often referred to as a "Hi/Low" gas delivery system.

Depending on the application, discharge velocity, or to control trajectory and distance, the bore of the gun barrel or tube may be rifled or smooth. The rifling provides spin-control and promotes dynamic stability to ensure that that nose of the projectile will impact at a selected target. Further, careful consideration of projectile geometry, payload and the like may also contribute to ensuring that a target aimed at will be reached and the payload expelled.

U.S. Pat. No. 7,086,337 (issued Aug. 8, 2006) to Klein discloses non-lethal ammunition for a riot gun which includes a forwardly open casing, a projectile mountable in and dischargeable from the casing, a propellant cartridge extending into the casing interior, and a UV curable adhesive disposed in sealing relation about the propellant to effectuate uniform firing of the projectile. The projectile includes rearward and forward end portions each provided with a central cavity with the rearward cavity enclosing the cartridge, a weight in the forward cavity for balancing and increasing the mass of the projectile, and a subassembly carrying in a nose thereof a chemical payload or chemical agent, the subassembly including a stem sized for interference fitment within the forward cavity to secure the subassembly to the projectile and having a chamber for positioning the weight in the forward cavity Although many of the known riot control systems are believed suitable for the uses intended, there is an ongoing need for improvements in such ordnance.

An object of this invention is the provision of high-low pressure non-lethal/less lethal ammunition that uses the high pressure provided by ignition of a conventional explosive, such as from firing a standard .38 or .44 cartridge case, to create a high-pressure gas to provide a predictable and reliable quantity of low-pressure gas to propel a projectile, fitted to the cartridge, away from its fitment at a relatively low but predetermined velocity.

Another object of this invention is the provision of non-lethal/less lethal ammunition having a gas delivery system that will effectively control and transform the high-energy burst of the propellant from a high velocity to a low velocity.

Another object of this invention is provision of a gas delivery system in non-lethal/less lethal ammunition that will direct and diffuse the energy of propellant gases from a high-pressure expansion chamber into a low-pressure chamber to propel the projectile from the cartridge and weapon at a low velocity.

Another object of this invention is provision of non-lethal/less lethal ammunition having a removable and reloadable high-pressure chamber.

Another object of this invention is provision of non-lethal/less lethal ammunition having a reloadable cartridge system, including a reloadable delay sleeve that controls the burning and replaced for the next use of the cartridge, that is cost effective and saves costs in training.

Another object of this invention is provision of non-lethal/less-lethal ammunition having a reloadable propelling charge that consists of a modified conventional .38 or .44 cartridge case, primer and propellant which is the power source for firing and replaced for the next use of the cartridge, that is cost effective and saves costs in training.

Another object of this invention is provision of non-lethal/less lethal ammunition having a projectile that is configured to fly, and impact, nose first, while describing a predetermined ballistic trajectory.

Another object of this invention is provision of non-lethal/less lethal ammunition wherein the balance and/or weight of the projectile may be changed simply such as by varying the thickness of the walls or base and/or making the walls or base thinner or thicker.

Another object of this invention is the provision of a spin-stabilized projectile that does not shatter upon impact, and carries an aerodynamic shaped nose (or payload) comprised of a material that does not shatter upon impact, but bounces or expands, or a material having a payload chamber for carrying a tear gas and other non-lethal chemicals that shatters and the chemicals dispersed upon impact.

Another object of this invention is the provision of a projectile configured such that the mass center, or center of gravity, of the projectile is located proximate the nose at the forward end of the projectile so as to maintain the nose in position for impact.

Another object of this invention is the provision of spin-stabilized combination of grenade launching tube and expellable projectile, the projectile being generally cylindrical, bi-chambered, and provided with an exterior driving band, or obturating rib, in encircling relation with an interior bulkhead that divides the projectile into two interior chambers, the driving band cooperating with the interior wall of the launching tube to control spin of the projectile when propelled therefrom.

It would be desirable, and is an object of this invention, to provide non-lethal riot gun ammunition that has the desired accuracy and which employs a projectile which is usable for different types of applications (i.e. a barricade penetrating tear gas head, UV, dust dispersal, trauma inducing etc.), thus improving upon manufacturing techniques and reducing costs.

As subsequently detailed, the present invention is directed to and achieves the above desired objects.

SUMMARY OF THE INVENTION

The instant invention provides a non-lethal/less lethal ammunition comprising: a bi-chambered projectile and a cup-shaped shell casing, the projectile being releasably mounted at a rearward end to the casing and closed at a forward end by a nose, and configured such that the center of gravity of the assembly (projectile and nose) is towards the forward end of the assembly whereby the nose will impact upon reaching a target, the casing including a gas supply arrangement wherein a gas diffuser plug consisting of a removable and reloadable high pressure chamber and a degradable delay sleeve are arranged to radially discharge uniformly burnt propellant gases at high energy and reduce the gases to a lower pressure, wherein degradation of the delay sleeve materials controls the rate of discharge and ensures that complete uniform burning takes place, and wherein the low pressure gases engage a cup-shaped chamber at the rearward end of the projectile body wherein to propel the projectile assembly from the casing at a low velocity.

The invention provides non-lethal/less lethal ammunition for use in a riot control firearms such as 37 mm and 40 mm firearms/launchers.

The invention provides non-lethal/less lethal ammunition wherein a projectile body permits a desired payload to be loaded for a desired circumstance by merely choosing the correct nose configuration.

According to this invention, in a first preferred embodiment thereof, non-lethal/less lethal ammunition for the controlled delivery of a projectile to a target, comprises:

a cup-shaped casing, said casing including a high-pressure expansion chamber to receive an explosive propellant;

a cylindrical projectile, said projectile being expellably mounted in said casing and comprised of a non-rupturable material adapted to remain intact and not burst into pieces following a violent impact, said projectile including, respectively, rearward and forward end portions, said rearward end portion and said casing cooperating to form a low pressure chamber when the projectile is mounted to the casing;

an impact nose secured to the forward end portion of said projectile; and a gas diffuser system for receiving high energy propellant gases from the expansion chamber and delivering the high pressure of the same into the low pressure chamber formed by the 37 mm/40 mm cartridge case following substantially complete and uniform burning of the propellant, said diffuser system being axially spaced from said projectile.

According to this preferred embodiment, the removable and reloadable high-pressure gas diffuser system comprises:

a gas diffuser plug, said plug including a cup-shaped body having a hollow interior, and a replaceable delay sleeve of degradable material, said cup-shaped body including a sidewall having an interior surface, a closed upper end, an open lower end, and at least one gas outlet port in said sidewall, and said delay sleeve being disposed in said hollow interior and in facing and closing relation, respectively, with and against said interior surface and said gas outlet port; and means for connecting the gas diffuser plug to said casing, said means for connecting placing the expansion chamber in fluid communication with the hollow interior of said gas diffuser plug and orienting the outlet port for directing propellant gases in a direction transverse to the expelling direction;

wherein uniformly burnt high energy propellant gas from the expansion chamber is first directed in a first direction generally along the geometric axis of the projectile and said casing, then in a second direction generally transverse to the geometric axis by degrading the material of the delay sleeve to pass through the outlet port or ports and into the low pressure chamber, and then in the first direction to be received in the first chamber and expel the projectile from the casing.

The sidewall of the gas diffuser plug is generally cylindrical. To adequately distribute the gases, the plug sidewall preferably includes a plurality of gas outlet ports. In one application, the gas diffuser plug includes four gas outlet ports arranged generally equiangularly about the sidewall and adapted to direct the burnt gases radially relative to the geometrical axis of the gas diffuser plug.

The replaceable delay sleeve is preferably comprised of a suitable material that will degrade, over time, when exposed to the high pressure and temperature of burnt propellant gases, to control and enable complete and uniform burning of the propellant.

The rearward end of the projectile body forms a cup-shaped chamber that is generally symmetrically centered along the geometric axis of the projectile, and formed by a generally cylindrical or annular surface, and a continuous planar surface that is transverse to the axis of the projectile. The burnt propellant gases from the diffuser plug are delivered into the low-pressure chamber and generally uniformly distributed across the planar surface to expel the projectile outwardly of the casing at a predetermined relatively low velocity.

The center of mass of the assembly of the projectile body, payload, and nose is proximate the forward end of the projectile assembly, wherein the projectile assembly will fly oriented with the impact nose first while describing a ballistic trajectory.

The nose is removably fitted into the forward end portion of the projectile body, thus enabling differently configured noses and payloads carried thereby to be replaced in a projectile body and expelling casing Preferably, the nose is comprised of non-rupturable and rupturable materials or component parts. In one application, the nose is comprised of non-rupturable elastomeric material, and is a "bouncer", and the projectile body is comprised of a polymeric material that does not shatter or break apart upon impact, such as nylon. In other applications, the nose carries a chemical to be dispersed and shatters upon impact.

Further, in some applications, the delay sleeve may be comprised of a thin metallic or plastic sleeve, which sleeve will degrade when the sleeve interacts with the burnt high energy propellant gases.

In another preferred embodiment, there is provided according to this invention non-lethal/less lethal ammunition adapted to launch a projectile from a tube, comprising:

a cup-shaped shell casing having a primer end and a payload expelling end, said primer end including a high energy expansion chamber for burning propellant gases and a cup-shaped gas diffuser plug for the controlled delivery of said burnt gases, said gas diffuser plug including an interior cavity for receiving burnt gases from said expansion chamber, at least one outlet port for radially discharging burnt propellant gases from said interior cavity, and a replaceable delay sleeve of degradable material, said delay sleeve being disposed in closing relation with said outlet port and of a material adapted to substantially simultaneously permit the propellant to burn completely and the sleeve material to degrade whereby to expose the outlet port and permit burnt propellant gases to pass through the outlet port;

a generally cylindrical bi-chambered projectile body of non-rupturable material expellably mounted in the expelling end of said shell casing, said projectile body including a rearward end portion mounted to the expelling end and in spaced relation to the gas diffuser plug, a forward end portion remote to the casing, a bulkhead dividing the interior of the projectile body into first and second chambers, and an exterior driving band to cooperate with the interior wall of the launching tube to spin-stabilize the projectile when launched, said first chamber being disposed in said rearward end portion, shallow, generally cup-shaped, and in juxtaposed spaced relation to said gas diffuser plug to form, with said casing, a low pressure chamber for receiving and distributing burnt propellant gases across the bulkhead, and said second chamber being disposed in said forward end portion;

a nose removably mounted in said second chamber;

wherein an assembly of said projectile body and said nose has a center of mass proximate to the forward end of the projectile body to enable the projectile to fly and impact nose first while describing a desired ballistic trajectory.

The nose may be solid and of non-rupturable material. Further, the nose may be multipart, include an interior chamber for carrying a payload, and be comprised of a rupturable material that breaks apart to disperse the payload upon impact. The nose includes a body portion dimensioned for fitment into the second chamber and in closing relation therewith, a forward impact head, and a payload for carrying teargas and the like, and which will deploy or otherwise scatter upon impact.

The non-lethal/less-lethal ammunition further comprises a gunpowder charge in the expansion chamber, and a percussion cap for exploding said gunpowder charge.

According to an aspect of this invention, there is provided a cartridge for the controlled delivery of a fluid comprising:

a cup-shaped shell casing, having a closed lower end, an open upper end, and a continuous vertical cylindrical side wall thereby defining a hollow interior;

a high energy expansion chamber provided in said lower end;

an explosive propellant charge in said expansion chamber;

a percussion cap in operable relation with said charge to explode the propellant; and a cup-shaped gas diffuser plug, having an open lower end, a closed upper end, and a continuous vertical cylindrical wall thereby defining a hollow interior cavity, the upper end portion of said cylindrical wall including a plurality of generally equiangularly spaced outlet ports for passing burnt gases radially from the interior cavity to the hollow interior, and a replaceable delay sleeve of degradable material disposed in said interior cavity and in closing relation with the outlet ports, communication of burnt gases into said interior cavity causing the material of the sleeve to degrade, over time, and be removed from closing relation with the outlet ports.

According to this invention, a brass or aluminum .38 or .44 caliber cartridge insert, which holds the propellant and primer, is pressed into a bore formed in the base of the shell casing.

The launching weapon firing pin strikes the primer igniting the propellant or gun powder inside the propelling charge. The burning propelling charge located partially inside the gas diffuser plug lined with the delay sleeve generates sufficient pressure and heat to burn through the delay sleeve to release the expanding propellant gases through the outlet port and into the low-pressure chamber. The rotating driving or obturating band around the projectile body engages rifling in the launcher tube and imparts a spin to the projectile. The pressure, created by the expanding gases in the low-pressure chamber, forces the projectile through the launching tube.

In a typical example, the spin imparted to the assembly of the projectile and impact nose is in the order of 2,000 plus rpm, and the discharge velocity of about 237 feet per second. Upon impact, depending on the nose, the nose bounces, expands, or shatters, causing the chemical payload to disperse, to incapacitate without causing a fatality. In no condition does the projectile casing ever shatter or rupture, such as by the nose impact forces being transmitted thereto.

The delay sleeve, propelling charge, and the nose are changeable to accommodate the type of ammunition desired.

The various features, advantages and other uses of the present invention will become more apparent by referring to the following description and drawings.

Throughout the following description and drawing, identical reference numbers refer to the same component shown in multiple figures of the drawings.

DESCRIPTION OF THE PREFERRED EMBODIMENT

Figure 1:
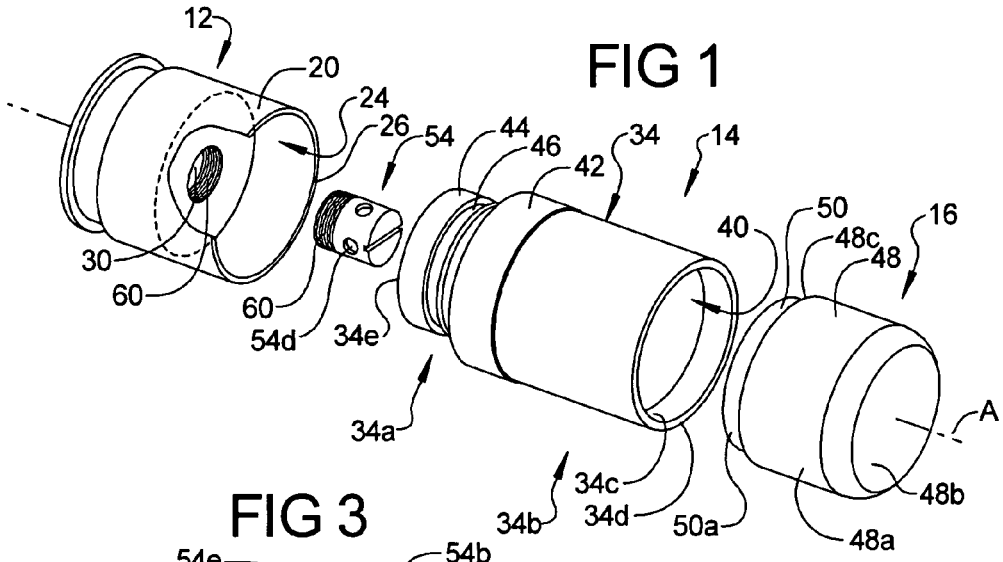
FIG. 1 is an exploded assembly view, in perspective, of non-lethal/less lethal ammunition according to the present invention, with a large caliber casing of a projectile mounting cartridge thereof partially cut-away to show detail.
Figure 5:
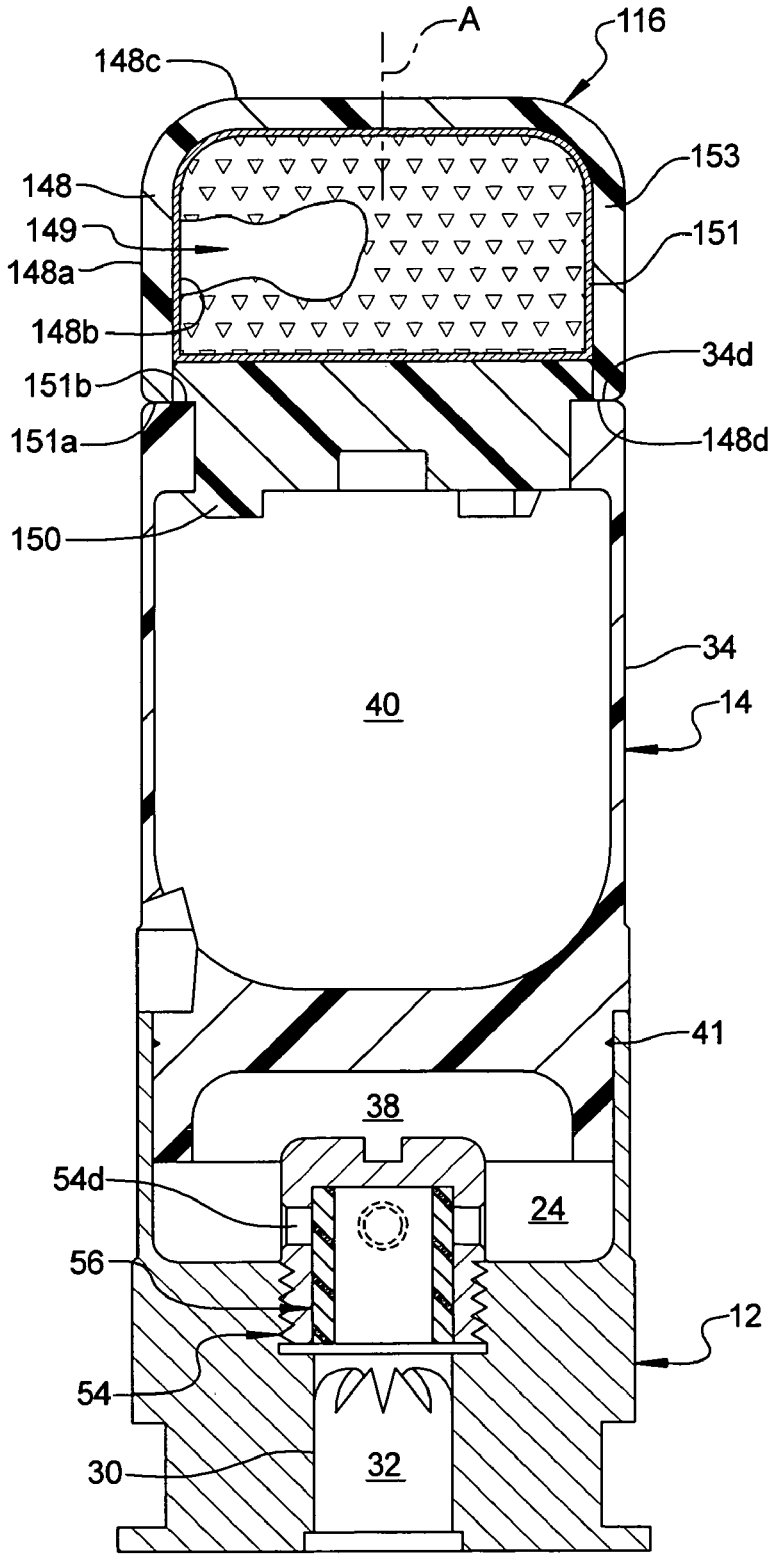
FIG. 5 is a cross-sectional view of an alternate embodiment of non-lethal ammunition according to the present invention

Referring now to the drawings, and in particular to FIGS. 1 and 5, preferred embodiments of non-lethal projectile ammunition according to the present invention are shown. Each is similar but differs in the payload utilized. In the ammunition shown in FIG. 1, the nose of the ammunition is solid, whereas in FIG. 5, the nose carries a payload, such as tear gas, as will be described in greater detail herein below. As will be described, each projectile ammunition is of the non-lethal or less lethal type and includes a removable and replaceable high-low propulsion system wherein high-pressure propellant gases in a pressure expansion chamber of the casing is diffused and delivered to a low-pressure chamber formed between the rearward end of the projectile body when expellably mounted to the casing.

The ammunition maintains strict compliance with the caliber or size requirement of the weapon or firearm (not shown) used to fire the ammunition. Illustrative of an application using the non-lethal ammunition herein is the M203 breech loading grenade launcher with rifled barrel that attaches to the M16 assault rifle or the M4 carbine and designed for a single shot 40 mm grenade. Typically, the M203 launches grenade ammunition through a 40 mm bore with a muzzle velocity of about 250 feet per second (76 m/s), to have an effective range as needed, depending on the application. In some applications, a smooth barreled weapon may be used.

Figure 2:
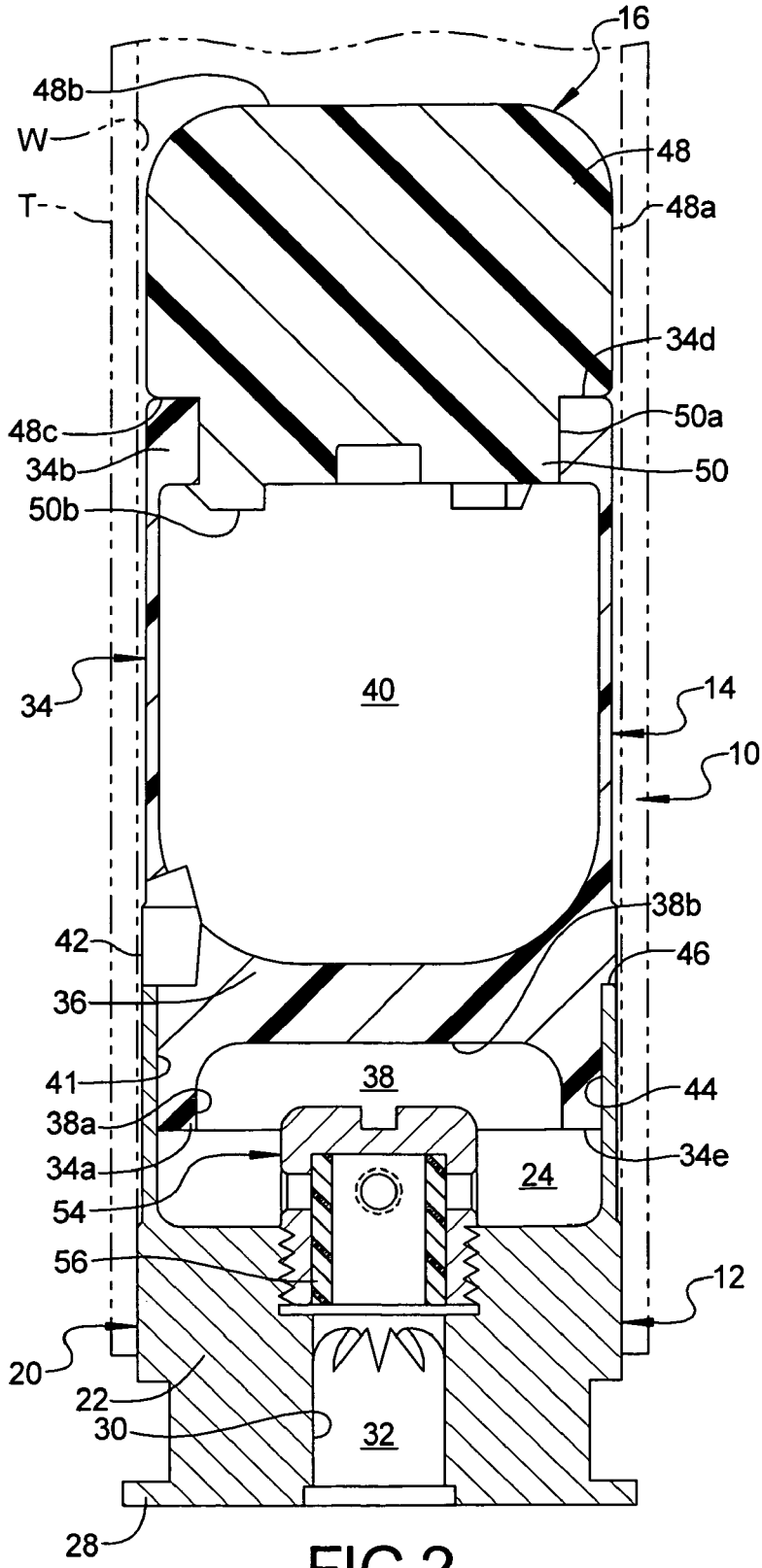
FIG. 2 is a cross-sectional view of the non-lethal ammunition, when assembled and mounted in the bore of a firing tube (shown in phantom), according to the present invention.

Referring to FIGS. 1 and 2, the non-lethal ammunition according to this invention is generally denoted by the reference number 10. The projectile ammunition 10 includes a shell casing 12, a projectile body 14, and an impact nose 16. The nose 16 is solid, not designed to rupture, formed into one-piece, of non-rupturable material or comprised of non-rupturable components, and comprises the payload.

The casing 12 is of a suitable metal, such as aluminum or the like, generally cup-shaped and includes a cylindrical sidewall 20 closed at a lower end by an end wall 22 and forms an interior chamber 24 leading to a payload expelling opening 26 (see FIG. 1) at the forward end. The end wall 22 includes an exterior end face 28 and a cylindrical bore 30 extends between the end face 28 and interior chamber 24. A cartridge case insert 32, which holds a propellant, such as gunpowder, and includes a primer or percussion cap, is pressed into the bore. Preferably, the propelling charge is loaded with smokeless gunpowder. The bore 30 forms a high-pressure expansion chamber to contain burnt propellant gases of the insert when the percussion cap is struck by the weapon pin.

Typically, the casing 12 is a readily available 40 mm cartridge case of aluminum.

The projectile 14 is in the form of a generally cylindrical shell or body 34 having rearward and forward end portions 34*a* and 34*b* and an interior wall or bulkhead 36 which divides the interior of the projectile body 34 to form rearward and forward chambers 38 and 40, respectively, in the rearward and forward end portions 34*a* and 34*b*. The rearward chamber 38 is generally cup-shaped and includes a cylindrical or annular wall 38*a* and a flat generally planar circular wall 38*b*. The rearward facing surface 38*b* of the bulkhead 36 is disposed in a plane generally perpendicular to a geometrical axis "A" passing through the projectile body 34 and shell casing 12 when the projectile 14 is expellably assembled to the casing 12. The rearward chamber 38 of the projectile in combination with the interior chamber 24 of the shell casing 12 forms a low-pressure chamber into which the high-energy expansion gases are directed. The expansion gases distribute generally uniformly across the flat surface 38*b* to promote controlled expulsion.

The forward chamber 40 is elongated, generally cylindrical, longitudinally extending, and outwardly open to receive the impact nose 16.

An obturating or driving band 42, generally at the location of the bulkhead 36, extends around the exterior of the projectile body 34 and is dimensioned to form a snug closure with the interior wall "W" (see FIG. 1) of the launch tube "T" to assist in spin-control.

A pair of grooves 44 and associated ribs 46 are formed around the exterior of the rearward end portion 34*a* to assist in controlled retention in the shell casing 12 and control spin during expulsion of the projectile body 34 from the casing 12. Additionally, the grooves 44 and ribs 46 cooperate in preventing, or at least reduce the energy of, burnt high-energy propellant gases passing between the fitment interface formed by the projectile body 34 and the sidewall 20 of the shell casing 12. In this regard, one or both of the grooves are fitted with an O-ring seal 41.

Preferably and according to this invention, the projectile body 34 is comprised of a material that is resistant to rupture or shattering. It is important that the material of the projectile body does not suddenly break or burst into pieces upon application of a violent impact or blow thereto, such as resulting from impact of the nose 16 against a destination target.

According to this invention, a suitable material is an acetyl homopolymer, such as Delrin®. These polymers have high tensile strength, impact resistance and stiffness, outstanding fatigue endurance, and resistance to many chemicals. Further, these polymers offer dimensional stability and maintain natural lubricity at a wide end-use temperature range.

The nose 16 is generally cylindrical and includes a shaped head 48, and a body member 50, each arranged on a common axis, which axis is aligned with the geometric axis "A" when the nose 16 is assembled to the forward end portion of the projectile body 34. The shaped head 48 includes a cylindrical exterior surface 48*a*, a flat end face 48*b* adapted to face forwardly, and a flat end face 48*c* adapted to face rearwardly and seat against the forward end 34*d* of the projectile body 34. A rounded transition surface connects the exterior surface 48*a* to the end face 48*b* to improve the flight ballistics when the projectile moves through the air.

The body member 50 extends coaxially rearwardly from the end face 48*c* of the head 48 and includes a cylindrical exterior surface 50*a* and an end face 50*b*. The exterior surface 50*a* and end face 50*b*, at least in part, define a series of locking tabs which act against the surface 34*c* of the projectile body 34 and provide a snug gripping engagement therewith to permit the impact nose 16 to be removably mounted to the projectile 14 and form an end closure to the forward chamber 40.

The nose 16 is designed not to rupture. The nose 16 is formed into a one-piece component and from a material selected that is not rupturable. While many materials are contemplated, preferably the nose is comprised of nylon, a polyurethane elastomer, or a combination of both.

In another embodiment according to this invention, as shown in FIG. 5 and discussed hereinbelow, a like-shaped nose 116 is comprised of a rupturable material, or components that enable the nose 116 to rupture.

According to an important feature of this invention, a gas delivery or diffuser system is provided wherein a gas diffuser plug 54 is placed in fluid communication with the expansion chamber 30 to receive burnt high-energy propellant gas from the expansion chamber 30, reduce the pressure, and direct the burnt propellant gases into a low-pressure chamber, formed by the combined chambers 24 and 38 formed behind the rearward end of the projectile body 34, when the projectile 14 is expellably mounted to the shell casing 12.

Figure 3:
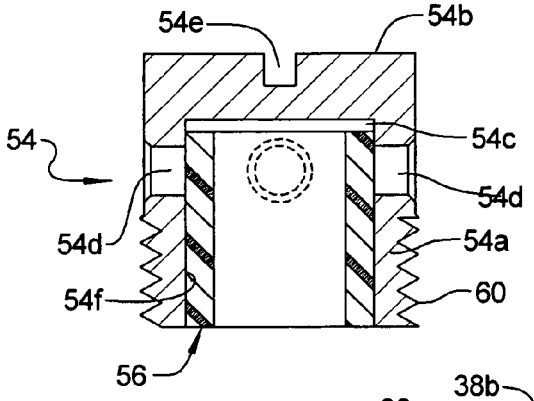
FIG. 3 is a side elevation view, in section, showing detail of a removable and replaceable gas diffuser plug operably associated with the mounting cartridge for communicating burnt high energy propellant gases used to propel a projectile of the ammunition of the present invention.

As shown in FIG. 3, the gas diffuser plug 54 is generally cup-shaped having a cylindrical sidewall 54*a* and a flat closure head 54*b*, and forms an interior cavity 54*c* adapted to receive the burnt high-energy propellant gases.

While many materials are suitable, preferably the gas diffuser plug 54 is of a metal that resists degradation by burnt gases, such as steel or stainless steel. Preferably, the shell casing 12 is of brass or aluminum.

At least one vent hole or gas outlet port 54*d* is provided in the sidewall 54*a* to pass the burnt propellant gases from the bore 30 into the casing interior 24. Preferably, a plurality of gas outlet ports of suitable diameter and shape are provided to ensure uniform distribution of burnt propellant gases. In the embodiment illustrated, four outlet ports 54*d* are provided, each generally circular in shape, disposed equiangularly, and adapted to pass the burnt gases radially (i.e., in a direction transverse to the expelling direction).

Matching thread 60 is provided on the exterior sidewall 54*a* of the plug 54 and on the interior wall of the bore 30 to enable the gas diffuser plug to be removably mounted to the shell casing 12. To enable rapid replacement or permit cleaning and recharging of the shell casing for reuse, the top surface of the closure head 54*b* is provided with a slot 54*e* adapted to be engaged by a conventional tool, such as a screwdriver.

Further, and important to the invention herein, a replaceable delay sleeve 56 of degradable material is fitted into the high pressure interior cavity or chamber 54*c*, against the interior surface 54*f* of the sidewall 54*a*, and in closing relation with the vent hole or outlet port 54*d*. The delay sleeve 56 is of material adapted to degrade by the action of the burnt high-energy propellant gases directed thereagainst and of a thickness calculated such that the propellant in the shell casing 12 will completely burn substantially simultaneously with the degrading of the sleeve material, whereby the ports 54*d* become open (i.e., exposed) and the gases expelled into the low-pressure chamber, comprised of chambers 24 and 38.

The delay sleeve 56 may be comprised of a polymeric material, such as nylon, polyurethane, or a polypropylene, or a metal, such as brass or aluminum.

When the projectile 14 and shell casing 12 are assembled, a low-pressure chamber 24 and 38 is formed behind the projectile body 34. In such assembly, the forward end 54*b* of the gas diffuser plug 54 is spaced axially rearwardly and away from the rearward end 34*e* of the projectile 14. The cup-shaped rearward chamber 38 of the projectile 14 is coaxially juxtaposed above and about the top 54*b* of the gas diffuser plug 54.

The assembly of the projectile 14 and the nose 16 is nose heavy, such that the projectile assembly will fly and impact nose first while describing a desired ballistic trajectory. That is, the mass center, or center of gravity of the projectile assembly, is forwardly and proximate to the head 48 of the nose 16 and the projectile assembly will not tumble in flight. In general, in the embodiment shown, the mass center is located proximate to the interface between the end face 48*c* of the nose head 48 and the front end face 34*d* of the projectile body 34, against which the nose head 48 seats.

According to this invention, the nose may also be configured to carry a special payload, in the form of a scatterable or dispersible substance, such as tear gas, dye, UV fluids, or other non-lethal material.

Referring to FIG. 5, the non-lethal ammunition is as described above, and the nose, generally indicated by the reference number 116, is substantially on the exterior identical to the nose shown and described herein above. According to this embodiment, the nose 116 is generally cylindrical and includes a shaped head 148 and a body member 150, the head fitted to the body to form a unit having substantially the same size and shape as the nose 16. When assembled together, the head and body 148 and 150 are coaxially arranged on a common axis, which axis is aligned with the geometric axis "A" when the nose 116 is assembled to the forward end portion of the projectile body 34.

The shaped head 148 is cup-shaped and includes an interior chamber 149. The head 148 includes exterior and interior surfaces 148*a* and 148*b*, respectively, a flat forward end face 148*c* adapted to face forwardly, and a flat end face 148*d* adapted to face rearwardly and seat against the forward end 34*d* of the projectile body 34. A rounded transition surface connects the exterior surface 148*a* to the forward end face 148*b* to improve the flight ballistics when the projectile moves through the air.

The body member 150 includes an annular collar 151, which includes a rearwardly facing support surface 151*a* and exterior cylindrical surface 151*b*. The support surface 151*a* seats upon the forward end 34*d* of the projectile body 34. The exterior cylindrical surface 151*b* is dimensioned to be fitted within the chamber 149 and engage the interior surface 148*b* of the chamber 149.

The nose 116, when assembled, is adapted to be removably mounted to the projectile 14 and form an end closure to the forward chamber 40, much as shown and described as regards the one-piece nose 16 herein above. Further, the nose 116 is formed of a rupturable material.

A dispersible medium, such as an inert powder or tear gas, shown by the reference numeral 153, or like material that scatters upon bursting impact of the nose, is provided in the chamber 149 when the head and body members 148 and 150 are united. For clarity, a portion of the material 153 is cutaway to show the interior cup-shaped chamber 149 formed within the nose 116.

In order to fire the ammunition 10, in operation, the projectile 14 and the nose 16, or 116, are preassembled. The rearward end 34*a* of the projectile assembly is loaded into the chamber 24 of the shell casing 12, which casing is preloaded with the propellant or propelling charge, and which propellant insert seals the expansion chamber 30 and the bottom of the casing 12. The shell casing and projectile assembly are loaded into the grenade launcher for firing.

Figure 4:
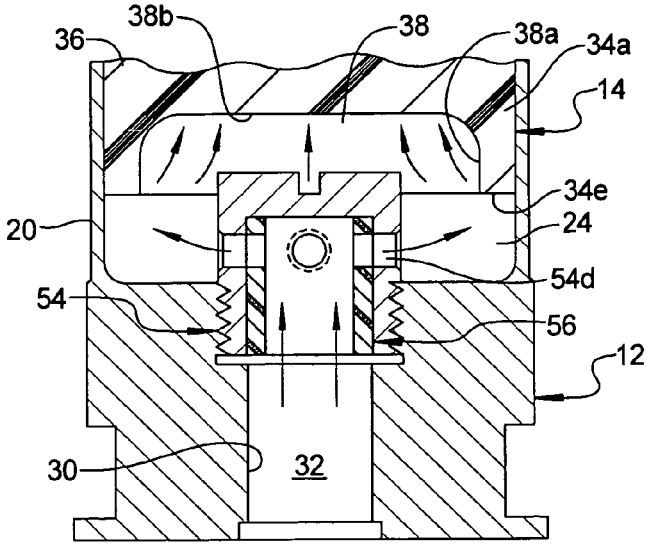
FIG. 4 is a side elevation view, in section, of the rearward end of the non-lethal ammunition illustrating a gas delivery system wherein burnt high-energy propellant gases are directed radially outwardly and upwardly from the gas diffuser plug and then upwardly and into a low-pressure chamber formed in the rearward end of the projectile body wherein to propel the projectile from the firing tube/launcher barrel.

Upon firing, turning to FIG. 4, the propellant is exploded in the high-energy expansion chamber 30, burnt high-energy propellant gases fill the interior cavity 54*c*, the delay sleeve 56 is degraded and the vent holes 54*d* opened, and the burnt gases radially diffused into the low-pressure chamber 24 and 38 behind the projectile 14. The gases enter the cup-shaped chamber 38 and uniformly distribute against the annular wall 38*a*, whereupon the projectile assembly is issued from the casing.

It is to be, thus, appreciated by interchangeability of the nose, payload, and projectile body, the type of ammunition defined by the projectile can be altered and the cost of manufacture greatly reduced.

Additionally, the gas diffuser plug 54 does not have to be discarded after use. The delay sleeve 56, although burnt by the explosion gases, may simply be replaced with a new delay sleeve. Further, the material selected for the delay sleeve enables the user to control the burn time before the gases are converted from high to low velocity expulsion.

Although particular embodiments of the invention have been described and illustrated herein, it is recognized that modifications and variations may readily occur to those skilled in the art and consequently, it is intended that the claims be interpreted to cover such modifications and equivalents

Having thus described the invention, what is claimed is:

1. Non-lethal ammunition for the controlled delivery of a projectile to a target, comprising:

a cup-shaped casing, said casing including a high-pressure expansion chamber to receive an explosive propellant;

a cylindrical projectile, said projectile being expellably mounted in said casing and comprised of a non-rupturable material adapted to remain intact and not burst into pieces following a violent impact, said projectile including, respectively, rearward and forward end portions, said rearward end portion and said casing cooperating to form a low-pressure chamber when the projectile is mounted to the casing;

an impact nose secured to the forward end portion of said projectile; and a gas diffuser system for receiving high pressure propellant gases from the high-pressure expansion chamber and delivering the high pressure propellant gases from the high-pressure expansion chamber into the low-pressure chamber following substantially complete and uniform burning of the explosive propellant, said diffuser system being axially spaced from said projectile; and wherein said gas diffuser system includes a gas diffuser plug, the gas diffuser plug including a cup-shaped body having a hollow interior and a delay sleeve of degradable material, said cup-shaped body including a sidewall having an interior surface, an upper end, an open lower end, and at least one gas outlet port in said sidewall, and said delay sleeve being disposed in said hollow interior and in facing and closing relation with and against said interior surface and said gas outlet port.

2. The ammunition as claimed in claim 1, wherein the gas diffuser system further comprises:

means for connecting said gas diffuser plug to said casing, said means for connecting placing the high-pressure expansion chamber in fluid communication with the hollow interior of said gas diffuser plug and orienting said outlet port for directing propellant gases in a direction transverse to the expelling direction; and wherein burnt high pressure propellant gas from the high-pressure expansion chamber is first directed in a first direction generally along the geometric axis of said projectile and said casing, then in a second direction generally transverse to the geometric axis of said projectile by degrading the material of the delay sleeve to pass through said outlet port and into the low-pressure chamber to expel the projectile from the casing.

3. The ammunition as claimed in claim 2, wherein said sidewall of said gas diffuser plug is generally cylindrical and includes four gas outlet ports, said ports generally arranged equiangularly about said sidewall.

4. The ammunition as claimed in claim 2, wherein said nose is comprised of an elastomeric material and said projectile and said delay sleeve are comprised of nylon.

5. The ammunition as claimed in claim 2, wherein said delay sleeve is comprised of a polymeric material.

6. The ammunition as claimed in claim 2, wherein said gas diffuser plug is comprised of stainless steel.

7. The ammunition as claimed in claim 1, wherein said low pressure chamber is substantially symmetrically centered along the geometric axis of the projectile, said high-pressure expansion chamber is formed by a generally annular surface and a continuous planar surface, and the burnt propellant gases in said low-pressure chamber are substantially uniformly distributed across said planar surface to expel the projectile.

8. The ammunition as claimed in claim 1, wherein said projectile has a forward end, and said nose is generally T-shaped and includes a body member extending from a head, said body member being adapted to be received in said low-pressure chamber and form a snug gripping fitment with the interior wall thereof and the head engaging said forward end of said projectile, an assembly of said projectile and said nose having a center of mass proximate to the forward end of said projectile wherein said projectile will fly and impact said nose first while describing a ballistic trajectory.

9. The ammunition as claimed in claim 8, wherein said nose is comprised of an elastomeric material and said projectile is comprised of a polymeric material.

10. The ammunition as claimed in claim 8, wherein the head of the impact nose is cup-shaped and includes an interior chamber, the head being formed from a rupturable material and said interior chamber is adapted to receive a dispersible medium.

11. Non-lethal ammunition adapted to launch a projectile from a tube, comprising:

a cup-shaped shell casing having a primer end and a payload expelling end, said primer end including a high energy expansion chamber for burning propellant gases and a cup-shaped gas diffuser plug for the controlled delivery of said burnt gases, said gas diffuser plug including an interior cavity for receiving burnt gases from said expansion chamber, at least one outlet port for radially discharging burnt propellant gases from said interior cavity, and a replaceable delay sleeve of degradable material, said delay sleeve being disposed in closing relation with said outlet port and of a material adapted to substantially simultaneously permit the propellant to burn completely and the sleeve material to degrade whereby to expose the outlet port and permit burnt propellant gases to pass through the outlet port;

a generally cylindrical bi-chambered projectile body of non-rupturable material expellably mounted in the expelling end of said shell casing, said projectile body including a rearward end portion mounted to the expelling end and in spaced relation to the gas diffuser plug, a forward end portion remote to the casing, a bulkhead dividing the interior of the projectile body into first and second chambers, and an exterior driving band to cooperate with the interior wall of the launching tube to spin-stabilize the projectile when launched, said first chamber being disposed in said rearward end portion, shallow, generally cup-shaped, and in juxtaposed spaced relation to said gas diffuser plug to form, with said casing, a low pressure chamber for receiving and distributing burnt propellant gases across the bulkhead, and said second chamber being disposed in said forward end portion;

a nose removably mounted in said second chamber, wherein an assembly of said projectile body and said nose have a center of mass proximate to the forward end of the projectile body to enable the projectile to fly and impact nose first while describing a desired ballistic trajectory.

12. The non-lethal ammunition of claim 11, further comprising a gunpowder charge in said expansion chamber, and a percussion cap for exploding said gunpowder charge.

13. A cartridge for the controlled delivery of a fluid comprising:

a cup-shaped shell casing, having a closed lower end, an open upper end, and a continuous vertical cylindrical side wall thereby defining a hollow interior;

a high energy expansion chamber provided in said lower end;

an explosive propellant charge in said expansion chamber;

a percussion cap in operable relation with said charge to explode the propellant; and a cup-shaped gas diffuser plug having an open lower end, a closed upper end, and a continuous vertical cylindrical wall thereby defining a hollow interior cavity, the upper end portion of said cylindrical wall including a plurality of generally equiangularly spaced outlet ports for passing burnt gases radially from the interior cavity to the hollow interior, and a replaceable delay sleeve of degradable material disposed in said interior cavity and in closing relation with the outlet ports, communication of burnt gases into said interior cavity causing the material of the sleeve to degrade, over time, and be removed from closing relation with the outlet ports.

14. The cartridge of claim 13, further wherein said delay sleeve is comprised of a material and of a thickness calculated such that the propellant will completely burn substantially simultaneously with the degrading of the sleeve material and thereby control the burn time before the gases are converted from high to low velocity, whereupon the delay sleeve is replaced for the next use of the cartridge.

15. The cartridge of claim 14, wherein the delay sleeve is comprised of a metal or a polymeric material selected from the group consisting of nylon, polyurethane, polypropylene, brass, and or aluminum.

16. The cartridge of claim 14, wherein the delay sleeve is comprised of thin aluminum foil.

17. Non-lethal ammunition for the controlled delivery of a projectile to a target, comprising:

a cup-shaped casing, said casing including a high-pressure expansion chamber to receive an explosive propellant;

a cylindrical projectile, said projectile being expellably mounted in said casing and consisting of a polymeric material adapted to remain intact and not burst into pieces following a violent impact, said projectile including, respectively, rearward and forward end portions, said rearward end portion and said casing cooperating to form a low pressure chamber when the projectile is mounted to the casing;

an impact nose secured to the forward end portion of said projectile; and a reusable gas diffuser system for receiving high pressure propellant gases from the high-pressure expansion chamber and delivering the high pressure propellant gases from the high-pressure expansion chamber into the low-pressure chamber following substantially complete and uniform burning of the explosive propellant, said diffuser system being axially spaced from said projectile and comprising a replaceable delay sleeve of degradable material.

* * * * *